US011871828B2

(12) United States Patent
Nicolson et al.

(10) Patent No.: US 11,871,828 B2
(45) Date of Patent: Jan. 16, 2024

(54) ATTACHMENT FOR A HANDHELD APPLIANCE

(71) Applicant: Dyson Technology Limited, Wiltshire (GB)

(72) Inventors: Annmarie Rita Nicolson, Bristol (GB); Emma Victoria Carson, Swindon (GB); Robert Mark Brett Coulton, Bristol (GB); Stephen Benjamin Courtney, Bath (GB)

(73) Assignee: Dyson Technology Limited, Malmesbury (GB)

( * ) Notice: Subject to any disclaimer, the term of this patent is extended or adjusted under 35 U.S.C. 154(b) by 209 days.

(21) Appl. No.: 15/468,492

(22) Filed: Mar. 24, 2017

(65) Prior Publication Data

US 2017/0273428 A1 Sep. 28, 2017

(30) Foreign Application Priority Data

Mar. 24, 2016 (GB) ..... 1605028
Mar. 24, 2016 (GB) ..... 1605030

(51) Int. Cl.
*A45D 20/52* (2006.01)
*A45D 20/50* (2006.01)
(Continued)

(52) U.S. Cl.
CPC ..... *A45D 20/50* (2013.01); *A45D 20/10* (2013.01); *A46B 7/02* (2013.01); *A46B 11/00* (2013.01); *A45D 20/52* (2013.01)

(58) Field of Classification Search
CPC ..... A45D 20/48; A45D 20/50; A45D 20/52; A45D 20/525; A45D 20/12; A45D 20/122;
(Continued)

(56) References Cited

U.S. PATENT DOCUMENTS 1,504,988 A 8/1924 Speetjens
2,476,002 A 7/1949 Stalker
(Continued)

FOREIGN PATENT DOCUMENTS

CN 1205617 A 1/1999
CN 101257816 A 9/2008
(Continued)

OTHER PUBLICATIONS

Courtney et al., U.S. Office Action dated Mar. 1, 2019, directed to U.S. Appl. No. 15/468,733; 6 pages.
(Continued)

*Primary Examiner* — Jacqueline T Johanas
*Assistant Examiner* — Sarah Woodhouse
(74) *Attorney, Agent, or Firm* — Faegre Drinker Biddle & Reath LLP

(57) ABSTRACT

An attachment including a casing having an air inlet for receiving an airflow from a hair styling apparatus, a hair engaging member, supported by the casing, and adapted to move relative to the casing between a first position and a second position under the action of an over-centre mechanism. First and second airflow outlets are formed between the casing and the hair engaging member when the hair engaging member is in the first and second position, respectively.

21 Claims, 7 Drawing Sheets

(51) Int. Cl.
*A46B 7/02* (2006.01)
*A45D 20/10* (2006.01)
*A46B 11/00* (2006.01)

(58) Field of Classification Search
CPC ..... A45D 20/124; A45D 2/36; A45D 4/10; A45D 24/32; A45D 24/10; A46B 9/023; A46B 2200/104; A46B 9/10; A46B 5/0091; A46B 7/06
USPC ..... 132/148, 271, 272, 227, 228, 229, 135, 132/142; 34/96–101
See application file for complete search history.

(56) References Cited

U.S. PATENT DOCUMENTS 3,107,675 A 10/1963 Embiricos
3,213,861 A 10/1965 Vitello
3,224,454 A 12/1965 Quinio et al.
3,386,453 A * 6/1968 Roberts ..... A45D 24/007 15/23
3,696,818 A 10/1972 Weber
3,814,898 A 6/1974 Levine
3,835,869 A 9/1974 Newman et al.
3,837,581 A 9/1974 Orsoff
3,854,489 A 12/1974 Doyle et al.
3,857,016 A 12/1974 Meyer et al.
3,890,984 A 6/1975 Lesetar
3,939,850 A 2/1976 Wahl
3,949,765 A 4/1976 Vallis
3,981,313 A 9/1976 Burke et al.
3,990,460 A 11/1976 Shalvoy
4,197,448 A 4/1980 Harigai
4,214,340 A 7/1980 Youngberg et al.
4,214,597 A 7/1980 Glassman
4,250,902 A 2/1981 Ihara
4,280,517 A 7/1981 Ihara
4,295,283 A 10/1981 Tomaro
4,335,732 A 6/1982 Megna
4,411,281 A 10/1983 Doern
4,422,464 A 12/1983 Josefsson
4,430,808 A 2/1984 Toyomi et al.
4,456,020 A 6/1984 van Deursen
4,471,791 A 9/1984 DeRoche
4,602,146 A 7/1986 Barns et al.
4,827,105 A 5/1989 Brown, Jr.
4,856,542 A 8/1989 Hollenberg et al.
4,860,775 A 8/1989 Reeves et al.
4,926,027 A 5/1990 Montagino et al.
4,936,027 A 6/1990 Tsuji
5,091,630 A 2/1992 Djuric
5,157,757 A 10/1992 McDougall
5,212,366 A 5/1993 McDougall
5,513,665 A 5/1996 Chan
5,515,874 A 5/1996 Denebeim
5,546,674 A 8/1996 Lange et al.
5,564,153 A 10/1996 Lange
5,626,156 A 5/1997 Vicory, Sr.
5,660,191 A 8/1997 Bontoux et al.
5,661,910 A 9/1997 Schepisi
5,671,547 A 9/1997 Truchet et al.
5,673,710 A 10/1997 Schaefer et al.
5,729,907 A 3/1998 Santhouse et al.
5,740,820 A 4/1998 Stern
5,765,575 A 6/1998 Denebeim
5,842,286 A 12/1998 Cantor
5,868,148 A 2/1999 Lindsey et al.
5,894,849 A * 4/1999 Ehlhardt ..... A45D 20/50 132/271
5,953,829 A 9/1999 Van Den Brug et al.
5,966,833 A 10/1999 Andis et al.
6,038,782 A 3/2000 Schepisi
6,053,181 A * 4/2000 Ehlhardt ..... A45D 20/50 132/269
6,070,596 A 6/2000 Altamore
6,199,259 B1 * 3/2001 Demaray ..... C23C 14/3407 204/298.12
6,377,749 B2 4/2002 Ohmura
6,434,855 B1 8/2002 Miller
6,662,811 B2 12/2003 Mugge et al.
6,668,840 B1 12/2003 Mugge et al.
6,725,562 B2 4/2004 Nakagawa et al.
6,739,071 B2 5/2004 Andis et al.
6,775,922 B2 8/2004 Langley et al.
6,986,212 B2 1/2006 Saida et al.
7,096,598 B1 8/2006 Myatt
7,124,763 B2 10/2006 Hafemann
7,631,646 B2 12/2009 Ragosta et al.
8,092,166 B2 1/2012 Nicolas et al.
8,122,896 B2 2/2012 Obermann
8,353,303 B2 1/2013 Kim
8,407,913 B2 4/2013 Langley et al.
8,573,231 B2 * 11/2013 Ragosta ..... A46B 13/001 132/119.1
9,010,276 B1 4/2015 Nevitt
9,526,310 B2 12/2016 Courtney et al.
9,752,789 B2 9/2017 Staniforth et al.
9,982,677 B2 5/2018 Beavis et al.
10,094,392 B2 10/2018 Poulton et al.
10,098,433 B2 10/2018 Habibi
2002/0092196 A1 7/2002 Tobin et al.
2003/0079366 A1 5/2003 Chang
2003/0177657 A1 9/2003 Andis et al.
2004/0045569 A1 3/2004 Chan
2004/0129289 A1 7/2004 Hafemann
2004/0261812 A1 12/2004 Csavas
2006/0076030 A1 4/2006 De Laforcade
2007/0119069 A1 5/2007 Shim
2007/0137060 A1 6/2007 Woodson
2008/0041406 A1 2/2008 Le
2009/0145002 A1 6/2009 Brewer et al.
2009/0199864 A1 8/2009 Smal
2009/0293901 A1 12/2009 Chan
2009/0293902 A1 * 12/2009 Ramos ..... A45C 11/008 132/287
2010/0024837 A1 2/2010 Obermann
2010/0226797 A1 9/2010 Fitton et al.
2010/0263223 A1 10/2010 Wynne
2011/0079239 A1 4/2011 Hall
2011/0198421 A1 8/2011 Yoe
2011/0296705 A1 12/2011 Yoe
2012/0234343 A1 9/2012 Cohen
2013/0008043 A1 1/2013 Correll, Jr. et al.
2013/0104415 A1 5/2013 Han et al.
2013/0111777 A1 5/2013 Jeong
2013/0133682 A1 5/2013 Yoe et al.
2013/0160316 A1 6/2013 Hadden
2013/0233336 A1 9/2013 Lazzaro et al.
2013/0269205 A1 10/2013 Hada
2014/0007448 A1 1/2014 Courtney et al.
2014/0083446 A1 3/2014 Julemont et al.
2014/0144037 A1 5/2014 Hadden
2014/0366910 A1 12/2014 Habibi
2015/0265022 A1 * 9/2015 Maclaine ..... A45D 20/50 132/219
2015/0265023 A1 9/2015 Maclaine et al.
2015/0265024 A1 9/2015 MacLaine
2016/0000201 A1 1/2016 Doran
2016/0120286 A1 5/2016 Han
2016/0356287 A1 12/2016 Khalitov et al.
2017/0273421 A1 9/2017 Heffer et al.
2017/0273422 A1 9/2017 Heffer et al.
2017/0273423 A1 9/2017 Mason et al.
2017/0273425 A1 9/2017 Stephens et al.
2017/0273429 A1 9/2017 Nicolson et al.
2017/0273430 A1 9/2017 Heffer et al.
2017/0273431 A1 9/2017 Courtney et al.
2018/0064228 A1 3/2018 Xiao et al.

FOREIGN PATENT DOCUMENTS

CN 201337073 11/2009
CN 101662969 A 3/2010

(56) References Cited

FOREIGN PATENT DOCUMENTS

| | | | | |
|---|---|---|---|---|
| CN | 201691269 | U | 1/2011 | |
| CN | 102150990 | A | 8/2011 | |
| CN | 201986906 | | 9/2011 | |
| CN | 202436376 | U | 9/2012 | |
| CN | 202496615 | U | 10/2012 | |
| CN | 202653444 | U | 1/2013 | |
| CN | 103027468 | A | 4/2013 | |
| CN | 203106087 | U | 8/2013 | |
| CN | 103429113 | A | 12/2013 | |
| CN | 103829527 | A | 6/2014 | |
| CN | 104921437 | A | 9/2015 | |
| CN | 204838408 | U | 12/2015 | |
| CN | 207023591 | U | 2/2018 | |
| CN | 207322932 | U | 5/2018 | |
| CN | 207322933 | U | 5/2018 | |
| DE | 511589 | | 10/1930 | |
| DE | 568043 | C | 1/1933 | |
| DE | 6928170 | U | 12/1969 | |
| DE | 25 08 951 | | 9/1976 | |
| DE | 2618819 | A1 | 11/1977 | |
| DE | 2624925 | A1 | 12/1977 | |
| DE | 79 25 952 | | 1/1980 | |
| DE | 29816450 | U1 | 3/1999 | |
| EP | 0 482 906 | | 4/1992 | |
| EP | 2 823 726 | | 1/2015 | |
| GB | 725095 | A | 3/1955 | |
| GB | 857564 | | 12/1960 | |
| GB | 1 346 034 | | 2/1974 | |
| GB | 1407403 | A | 9/1975 | |
| GB | 1465855 | A | 3/1977 | |
| GB | 1467642 | A | 3/1977 | |
| GB | 1 519 042 | | 7/1978 | |
| GB | 2100981 | A | 1/1983 | |
| GB | 2515812 | | 1/2015 | |
| GB | 2524304 | A | 9/2015 | |
| GB | 2526049 | | 11/2015 | |
| GB | 2526768 | | 12/2015 | |
| GB | 2527834 | A | 1/2016 | |
| GB | 2528574 | | 1/2016 | |
| JP | 49-115182 | | 1/1973 | |
| JP | 52-36579 | | 8/1975 | |
| JP | 52-95581 | | 1/1976 | |
| JP | 52-72663 | | 6/1977 | |
| JP | 52-86851 | | 7/1977 | |
| JP | 53-64672 | | 5/1978 | |
| JP | 53-71976 | | 6/1978 | |
| JP | S54-78255 | A | 6/1979 | |
| JP | S54-117269 | A | 9/1979 | |
| JP | S57-196907 | A | 12/1982 | |
| JP | 59-95010 | | 5/1984 | |
| JP | 60-100902 | | 6/1985 | |
| JP | S60-134402 | U | 9/1985 | |
| JP | S61-145248 | U | 9/1986 | |
| JP | S62-41606 | A | 2/1987 | |
| JP | S62-44208 | A | 2/1987 | |
| JP | S64-29208 | A | 1/1989 | |
| JP | 1-155901 | | 10/1989 | |
| JP | 3-267007 | | 11/1991 | |
| JP | H6-7217 | A | 1/1994 | |
| JP | 10-42932 | | 2/1998 | |
| JP | H10-71019 | A | 3/1998 | |
| JP | 10-179238 | | 7/1998 | |
| JP | 2000-506428 | | 5/2000 | |
| JP | 2000-175723 | | 6/2000 | |
| JP | 2000-516483 | A | 12/2000 | |
| JP | 2001-61534 | | 3/2001 | |
| JP | 2004-222745 | A | 8/2004 | |
| JP | 2004-225705 | A | 8/2004 | |
| JP | 2005-177155 | A | 7/2005 | |
| JP | 2007-105144 | | 4/2007 | |
| JP | 3159520 | | 5/2010 | |
| JP | 2010-201067 | A | 9/2010 | |
| JP | 2013-59580 | | 4/2013 | |
| JP | 2015-181947 | | 10/2015 | |
| JP | 2016-16328 | A | 2/2016 | |
| KR | 20-0388514 | Y1 | 6/2005 | |
| KR | 10-2008-0030428 | | 4/2008 | |
| KR | 10-2012-0095206 | A | 8/2012 | |
| RU | 2417719 | C1 | 5/2011 | |
| SU | 1340734 | | 9/1987 | |
| WO | 79/00374 | A1 | 6/1979 | |
| WO | WO-92/14378 | | 9/1992 | |
| WO | WO-9409669 | A1 * | 5/1994 | ..... A45D 20/50 |
| WO | 97/23147 | A1 | 7/1997 | |
| WO | WO-98/12944 | | 4/1998 | |
| WO | WO-98/27842 | | 7/1998 | |
| WO | WO-98/27843 | | 7/1998 | |
| WO | 02/45543 | A1 | 6/2002 | |
| WO | 03/030675 | | 4/2003 | |
| WO | WO-2007/077040 | | 7/2007 | |
| WO | WO-2010/115309 | | 10/2010 | |
| WO | WO-2010115309 | A1 * | 10/2010 | ..... A45D 20/12 |
| WO | 2012/097498 | | 7/2012 | |
| WO | 2013/014094 | | 1/2013 | |
| WO | 2013/120232 | A1 | 8/2013 | |
| WO | WO-2014/088157 | | 6/2014 | |
| WO | WO-2014/112260 | | 7/2014 | |
| WO | WO-2015/040496 | | 3/2015 | |
| WO | WO-2015/140506 | | 9/2015 | |
| WO | 2015/190217 | A1 | 12/2015 | |
| WO | WO-2016/027251 | | 2/2016 | |
| WO | WO-2016027251 | A1 * | 2/2016 | ..... A45D 24/10 |
| WO | 2017/158859 | A1 | 9/2017 | |

OTHER PUBLICATIONS

Examination Report dated May 22, 2018, directed to GB Application No. 1605035.3; 2 pages.

Search Report dated Jul. 7, 2016, directed to GB Application No. 1605028.8; 2 pages.

Search Report dated Jul. 21, 2016, directed to GB Application No. 1605030.4; 1 page.

International Search Report and Written Opinion dated May 30, 2017, directed to International Application No. PCT/GB2017/050517; 13 pages.

Courtney et al., U.S. Office Action dated Jun. 26, 2019, directed to U.S. Appl. No. 15/468,733; 7 pages.

Teffer et al., U.S. Office Action dated Jul. 29, 2019, directed to U.S. Appl. No. 15/468,515; 18 pages.

Nicolson et al., U.S. Office Action dated Jul. 25, 2019, directed to U.S. Appl. No. 15/468,496; 9 pages.

Courtney et al., U.S. Office Action dated Feb. 6, 2020, directed to U.S. Appl. No. 15/468,733; 7 pages.

Heffer et al., U.S. Office Action dated Feb. 6, 2020, directed to U.S. Appl. No. 15/468,515; 16 pages.

Nicolson et al., U.S. Office Action dated Feb. 6, 2020, directed to U.S. Appl. No. 15/468,496; 10 pages.

Heffer et al., U.S. Office Action dated May 14, 2019, directed to U.S. Appl. No. 15/468,487; 13 pages.

Teffer et al., U.S. Office Action dated Dec. 27, 2019, directed to U.S. Appl. No. 15/468,500; 19 pages.

Heffer et al., U.S. Office Action dated Jul. 2, 2020, directed to U.S. Appl. No. 15/468,500; 22 pages.

Heffer et al., U.S. Office Action dated Oct. 15, 2020, directed to U.S. Appl. No. 15/468,500; 15 pages.

Heffer et al., U.S. Office Action dated May 15, 2019, directed to U.S. Appl. No. 15/468,500; 20 pages.

MacLaine et al., U.S. Office Action dated Apr. 15, 2020, directed to U.S. Appl. No. 15/656,432; 12 pages.

MacLaine et al., U.S. Office Action dated Oct. 15, 2020, directed to U.S. Appl. No. 14/656,432; 14 pages.

MacLaine et al., U.S. Office Action dated Sep. 9, 2019, directed to U.S. Appl. No. 14/656,432; 12 pages.

MacLaine et al., U.S. Office Action dated Aug. 16, 2017, directed to U.S. Appl. No. 14/656,432; 14 pages.

MacLaine et al., U.S. Office Action dated Dec. 14, 2018, directed to U.S. Appl. No. 14/656,432; 14 pages.

MacLaine et al., U.S. Office Action dated Feb. 10, 2017, directed to U.S. Appl. No. 14/656,432; 18 pages.

(56) References Cited

OTHER PUBLICATIONS

MacLaine et al., U.S. Office Action dated Jan. 12, 2018, directed to U.S. Appl. No. 14/656,432; 11 pages.
MacLaine et al., U.S. Office Action dated Jun. 29, 2018, directed to U.S. Appl. No. 14/656,432; 14 pages.
MacLaine, Office Action dated Dec. 8, 2017, directed to U.S. Appl. No. 14/656,375; 7 pages.
MacLaine, Office Action dated Jan. 6, 2017, directed to U.S. Appl. No. 14/656,375; 7 pages.
MacLaine, Office Action dated May 22, 2017, directed to U.S. Appl. No. 14/656,375; 8 pages.
MacLaine, U.S. Office Action dated Apr. 15, 2020, directed to U.S. Appl. No. 14/656,357; 11 pages.
MacLaine, U.S. Office Action dated Sep. 18, 2019, directed to U.S. Appl. No. 14/656,357; 14 pages.
MacLaine, U.S. Office Action dated Aug. 9, 2017, directed to U.S. Appl. No. 14/656,357; 13 pages.
MacLaine, U.S. Office Action dated Dec. 14, 2018, directed to U.S. Appl. No. 14/656,357; 12 pages.
MacLaine, U.S. Office Action dated Feb. 14, 2017, directed to U.S. Appl. No. 14/656,357; 15 pages.
MacLaine, U.S. Office Action dated Jan. 10, 2018, directed to U.S. Appl. No. 14/656,357; 11 pages.
MacLaine, U.S. Office Action dated Jun. 27, 2018, directed to U.S. Appl. No. 14/656,357; 13 pages.
Mason et al., U.S. Office Action dated Dec. 18, 2020, directed to U.S. Appl. No. 15/468,502; 14 pages.
Mason et al., U.S. Office Action dated Feb. 28, 2020, directed to U.S. Appl. No. 15/468,502; 17 pages.
Mason et al., U.S. Office Action dated Aug. 28, 2020, directed to U.S. Appl. No. 15/468,502; 15 pages.
Mason et al., U.S. Office Action dated May 23, 2019, directed to U.S. Appl. No. 15/468,502; 22 pages.
Nicolson et al., U.S. Office Action dated Feb. 19, 2021, directed to U.S. Appl. No. 15/468,496; 14 pages.
Courtney et al., U.S. Office Action dated Jun. 30, 2020, directed to U.S. Appl. No. 15/468,733; 7 pages.
Teffer et al., U.S. Office Action dated May 27, 2020, directed to U.S. Appl. No. 15/468,515; 21 pages.
The First Office Action dated Mar. 27, 2020, directed to CN Application No. 201710179681.6; 15 pages.
International Search Report and Written Opinion dated May 8, 2015, directed to International Application No. PCT/GB2015/050659; 12 pages.
International Search Report and Written Opinion dated May 31, 2017, directed to International Application No. PCT/GB2017/050519; 13 pages.
Search Report dated Jul. 13, 2016, directed to GB Application No. 1605031.2; 1 page.
Search Report dated Jun. 17, 2016, directed to GB Application No. 1605035.3; 1 page.
Search Report dated Sep. 12, 2014, directed to GB Application No. 1404982.9; 1 page.
Search Report dated Sep. 16, 2014, directed to GB Application No. 1404985.2; 1 page.
The First Office Action dated Mar. 31, 2020, directed to CN Application No. 201710179894.9; 15 pages.
Clarivate Analytics Copywritten translation of WO9709899, Paganini, WIPO Publication Date 1997 (Year: 1997).

* cited by examiner

ATTACHMENT FOR A HANDHELD APPLIANCE

REFERENCE TO RELATED APPLICATIONS

This application claims the priority of United Kingdom Application No. 1605028.8, filed Mar. 24, 2016, and United Kingdom Application No. 1605030.4, filed Mar. 24, 2016, the entire contents of each of which are incorporated herein by reference.

FIELD OF THE INVENTION

The present invention relates to an attachment for a handheld appliance, in particular a hair care appliance such as a hot air styling device.

BACKGROUND OF THE INVENTION

In a conventional hot air styling device, air is drawn into an inlet by a fan unit and directed towards the hair by an attachment or head. Depending on the style desired, the air may or may not be heated. The attachment often includes bristles onto which hair is wrapped and held for styling. The air is generally blown out of the attachment normal to the longitudinal surface of the attachment.

SUMMARY OF THE INVENTION

In a first aspect, the present invention provides an attachment for a hair styling apparatus, the attachment comprising a casing having an air inlet for receiving an airflow from a hair styling apparatus; a hair engaging member, supported by the casing, and adapted to move relative thereto between a first position and a second position, and wherein a first airflow outlet formed between the casing and the hair engaging member when the hair engaging member is in the first position; and a second airflow outlet, spaced from the first airflow outlet, formed between the casing and the hair engaging member when the hair engaging member is in the second position; and wherein the first airflow outlet is open and the second airflow outlet is closed when the hair engaging member is in the first position; and the first airflow outlet is closed and the second airflow outlet is open when the hair engaging member is in the second position.

The hair engaging member is preferably adapted to move in a rocking movement, relative to the casing. Preferably, the hair engaging member is pivotably supported within the casing and through a central axis of the hair engaging member. It is preferred that the hair engaging member is pivotably supported by pivot pins which mount the hair engaging member within the casing. The hair engaging member preferably has an angle of movement which is in the range from 5° to 30°.

Preferably, the hair engaging member moves into the first position when the attachment is drawn through a user's hair in a first direction and the hair engaging member moves into the second position when the attachment is drawn through the user's hair in a second direction opposing the first direction.

Each of the first airflow outlet and the second airflow outlet preferably comprise a plurality of outlet apertures. Furthermore, the plurality of outlet apertures are preferably positioned in a row.

Preferably, each of the first airflow outlet and the second airflow outlet are defined by a respective side face of the hair engaging member and a respective part of the casing. Each of the first airflow outlet and the second airflow outlet is preferably a slot shape. Preferably, the hair engaging member has an elongate form and each of the first airflow outlet and the second airflow outlet preferably extends substantially the length of the hair engaging member.

In a preferred embodiment, the attachment comprises two hair engaging members. Preferably, the casing comprises an outer casing section and an inner casing section, and a ledge of the inner casing section is located between the hair engaging members. In a first configuration of the attachment, a first hair engaging member is preferably in the first position defining a first airflow outlet with the ledge, and a second hair engaging member is preferably in the first position defining a second airflow outlet with the outer casing section. In a second configuration of the attachment, the first hair engaging member is preferably in the second position defining a third airflow outlet with the outer casing section, and the second hair engaging member is preferably in the second position defining a fourth airflow outlet with the ledge. Preferably, the first hair engaging member and the second hair engaging member move synchronously.

Furthermore, the attachment preferably moves between the first configuration and the second configuration under the action of an over-centre mechanism. In a preferred embodiment the over-centre mechanism is a torsion spring connected between the first hair engaging member and the second hair engaging member. The biasing function of the torsion spring may be realized in several alternative ways. For example, a magnetic latch or weighted moveable members or integrated ball bearings in a detent mechanism may be used.

Advantage is found in the over-centre mechanism for movement of the moveable members which functions to bias the movement of each moveable member in a direction opposing the current orientation of the moveable member, ensuring that the moveable members can tilt in the opposing direction without hindrance.

In a second aspect, the present invention provides an attachment for a hair styling apparatus comprising a casing having an air inlet for receiving airflow from a hair styling apparatus; a hair engaging member supported by the casing; a first airflow outlet between the casing and the hair engaging member; a second airflow outlet, spaced from the first airflow outlet, between the casing and the hair engaging member; and internal airflow directing means positioned within the casing to direct air towards the first airflow outlet and the second airflow outlet. Preferably, each of the first airflow outlet and the second airflow outlet are defined, at least in part, by a respective side wall of the casing.

The term "airflow directing means" refers to vanes, baffles, ribs or any other arrangement which guides airflow along an airflow path.

In a preferred embodiment, the internal airflow directing means comprises a plurality of vanes. The internal airflow directing means preferably comprises a plurality of casing vanes connected to the casing. Furthermore, the plurality of casing vanes comprises a first series of casing vanes located on a first side wall of the casing and adjacent to the first airflow outlet, and a second series of casing vanes located on a second side wall of the casing and adjacent to the second airflow outlet. Each vane in the first series of casing vanes is preferably orientated approximately perpendicular to an edge of the first side wall of the casing which defines the first airflow outlet, and each vane in the second series of casing vanes is orientated approximately perpendicular to an edge of the second side wall of the casing which defines the second airflow outlet. Preferably, the vanes in the first series of casing vanes and second series of the casing vanes are approximately evenly spaced.

In a further preferred embodiment, the internal airflow directing means comprises a plurality of edge vanes connected to the hair engaging member. The plurality of edge vanes preferably comprises a first series of edge vanes located on a first side face of the hair engaging member and adjacent to the first airflow outlet, and a second series of edge vanes located on a second side face of the hair engaging member and adjacent to the second airflow outlet.

Preferably, each vane in the first series of edge vanes is orientated approximately perpendicular to an edge of the hair engaging member adjacent the first airflow outlet, and each vane in the second series of edge vanes is orientated approximately perpendicular to an edge of the hair engaging member adjacent the second airflow outlet.

The vanes in the first series of edge vanes and second series of the edge vanes are preferably approximately evenly spaced. Preferably, the edge vanes and the casing vanes have a similar positioning pattern such that the edge vanes and casing vanes consecutively align with each other.

The hair engaging member preferably has an elongate form, and each of the first airflow outlet and the second airflow outlet preferably extends substantially the length of the hair engaging member.

In a preferred embodiment, the attachment comprises two said hair engaging members. Preferably, each hair engaging member forms, with the casing, a respective first air outlet and a respective second air outlet. The hair engaging members are preferably disposed side by side. The casing preferably comprises an outer casing section and an inner casing section, and a ledge of the inner casing section is located between the hair engaging members.

In a preferred embodiment, the internal airflow directing means further comprises a series of central baffles positioned between the hair engaging members and contacting an inner face of the ledge. Preferably, the series of central baffles extends parallel to an inner side face of a first hair engaging member and an inner side face of a second hair engaging member. Each baffle within the series of central baffles preferably has an open scoop shape adapted to turn the received airflow through approximately 90 degrees, towards the ledge.

Advantageously, turbulent airflow is minimized within the attachment and consequently the audible volume of the hot air styling device with attachment is reduced in use.

Preferably, a first series of inner edge vanes are located on a side face of the first hair engaging member proximal to the ledge. A second series of inner edge vanes are preferably located on a side face of the second hair engaging member proximal to the ledge. The baffles within the series of central baffles, and the vanes within the first and second series of inner edge vanes, preferably have a similar positioning pattern such that the baffles and the vanes consecutively align with each other.

Advantageously, the regular indentations along the side faces of the moveable members in combination with the internal central baffles and internal casing vanes, form jets from the airflow exiting the attachment.

In a third aspect, the present invention provides an attachment for a hair styling apparatus comprising a casing having an air inlet for receiving airflow from a hair styling apparatus; a hair engaging member supported by the casing, an airflow outlet between the casing and the hair engaging member and shaped to direct air over an external surface of the hair engaging member; and airflow guiding means extending over the external surface of the hair engaging member. Preferably, the airflow outlet is defined by a side face of the hair engaging member and a side wall of the casing.

The hair engaging member is preferably elongate in shape, and the airflow outlet extends substantially the length of the hair engaging member.

Preferably, the airflow guiding means comprises a series of ribs. Each rib in the series of ribs is preferably positioned parallel to an adjacent rib and a channel is defined therebetween. Each rib within the series of ribs preferably extends substantially perpendicular to the direction of the length of the hair engaging member. Preferably, the ribs within the series of ribs have a uniform rib width. Each channel in the series of ribs preferably has a uniform channel width, and the channel width is preferably greater than a width of a rib. In a preferred embodiment, the width of each channel is in the range from 2 mm to 4 mm.

Advantageously, the channels between adjacent ribs act to guide the airflow over the surface of the moveable members and consequently, even, parallel airstreams are blown down the shaft of the user's hair.

Preferably, the external surface of the hair engaging member has a generally arc profile perpendicular to the direction of the length of the hair engaging member. In a further preferred embodiment, the attachment comprises two said hair engaging members. The hair engaging members are preferably disposed side by side. The casing preferably comprises an outer casing section and an inner casing section, and a ledge of the inner casing section is located between the hair engaging members. Preferably, the attachment comprises a further airflow outlet between the casing and a second hair engaging member and the further airflow outlet is shaped to direct air over an external surface of the second hair engaging member.

In a fourth aspect, the present invention provides an attachment for a hair styling apparatus comprising an air inlet for receiving airflow from a hair styling apparatus; at least one air outlet; a chamber for conveying air from the air inlet to said at least one air outlet; wherein the air inlet is located at one end of the chamber, and the at least one air outlet extends along the length of the chamber; and the cross-sectional area of the chamber decreases in size from the air inlet along the length of the at least one air outlet.

Advantage is found in the reduction of the internal cross-sectional area of the attachment towards the downstream end of the attachment, because there is a greater consistency of pressure throughout the internal volume of the attachment. Furthermore, attachment of airflow to internal central baffles and internal side vanes is improved as a consequence of the progressive reduction of the internal cross-sectional area.

Preferably, the casing comprises a base located opposite to the air outlet. Preferably, the base is generally planar and slopes gradually towards the air outlet with increasing distance from the air inlet. The base preferably comprises a first layer and a second layer separated by an insulating cavity.

In a preferred embodiment, the attachment comprises a distal end opposite the air inlet, and an insulated cap located at the distal end. The insulated cap preferably has a heat resistant protrusion extending away from the air inlet.

In a fifth aspect, the present invention provides an attachment for a hair styling apparatus comprising a casing having an air inlet for receiving airflow from a hair styling apparatus; a hair engaging member supported by the casing; a first airflow outlet formed between the casing and the hair engaging member; a second airflow outlet, spaced from the first airflow outlet, between the casing and the hair engaging member; and at least one airflow barrier on an external surface of the attachment extending between the first airflow outlet and the second airflow outlet.

Preferably, airflow emitted through the first airflow outlet or the second airflow outlet is guided across the external surface of the hair engaging member by the at least one airflow barrier. In a preferred embodiment, the at least one airflow barrier has a height which is in the range of 1 mm to 4 mm. The at least one airflow barrier may preferably be a ridge.

A first airflow barrier is preferably located between the hair engaging member and the air inlet, and a second airflow barrier is preferably located between the hair engaging member and a distal end of the attachment opposite the air inlet. At least one of the first airflow barrier and the second airflow barrier is preferably connected to the hair engaging member. Further, at least one of the first airflow barrier and the second airflow barrier is preferably connected to the casing. Preferably, the hair engaging member is elongate in shape.

Advantage is found in the raised ridge adjacent to each end of the moveable members, which functions to avoid entrainment of ambient air.

In a sixth aspect, the present invention provides an attachment for a hair styling apparatus comprising a casing having an air inlet for receiving airflow from a hair styling apparatus; a hair engaging member supported by the casing and wherein the hair engaging member comprises an array of bristles protruding from an outer surface of the hair engaging member; and wherein each bristle within the array has an elongate form and an oval transverse cross-section.

Preferably, the casing comprises an array of bristles protruding from an outer surface of the casing. The array preferably comprises bristles arranged in parallel rows. Each bristle preferably has a spherical portion at the distal end. In a preferred embodiment, the attachment comprises two said hair engaging members supported by the casing, and the hair engaging members are preferably disposed side by side. In this preferred embodiment, the quantity of bristles within the array on each hair engaging member is preferably the same. Advantageously, the shape of bristle enables the attachment to move smoothly through the hair and minimizes tangling of the hair.

Features described above in connection with the first aspect of the invention are equally applicable to each of the second to sixth aspects of the invention, and vice versa.

BRIEF DESCRIPTION OF THE DRAWINGS

Preferred features of the present invention will now be described by way of example only with reference to the accompanying drawings, in which.

DETAILED DESCRIPTION OF THE INVENTION

Figure 1:
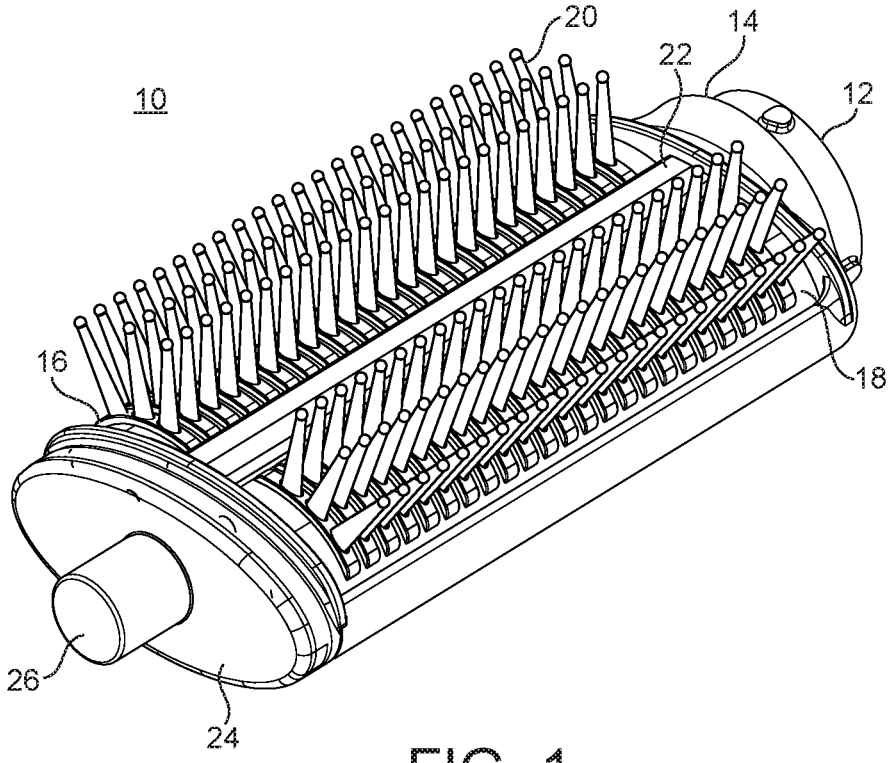
FIG. 1 is a perspective view of an attachment, according to an aspect of the invention.
Figure 2:
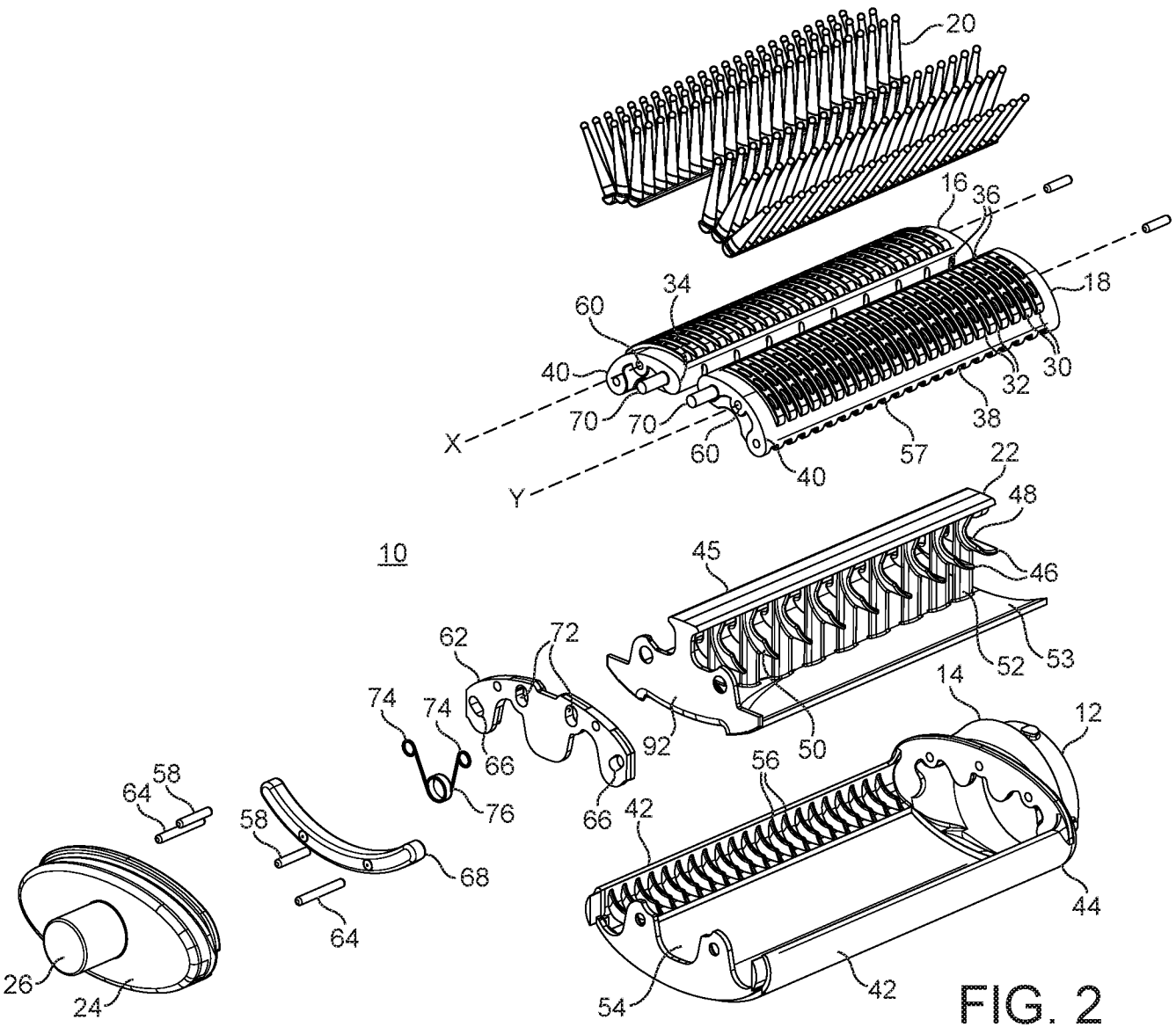
FIG. 2 is an exploded view of the attachment.
Figure 3:
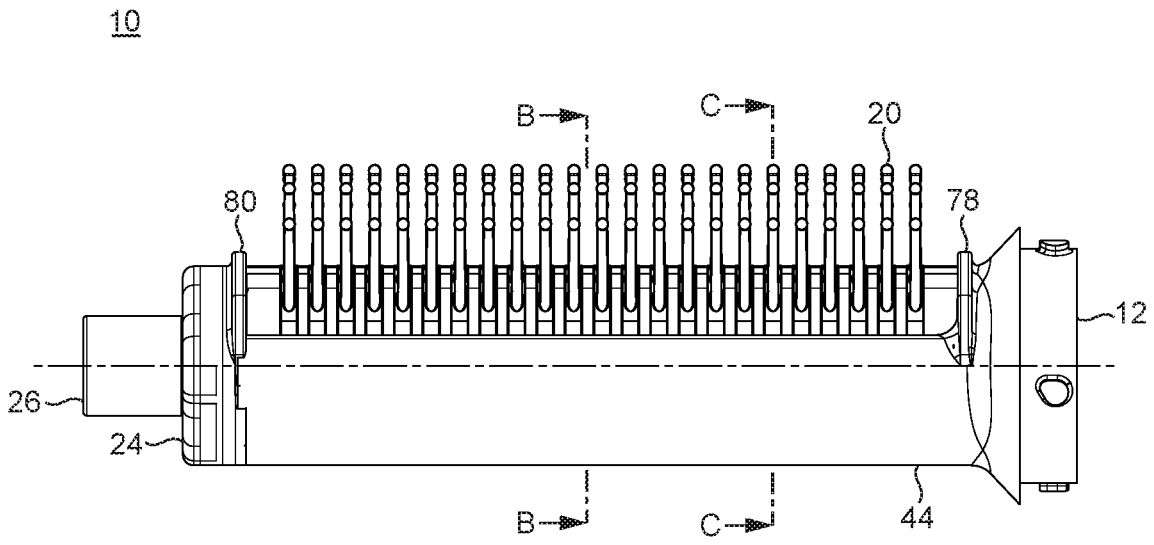
FIG. 3 is a side view of the attachment.
Figure 4:
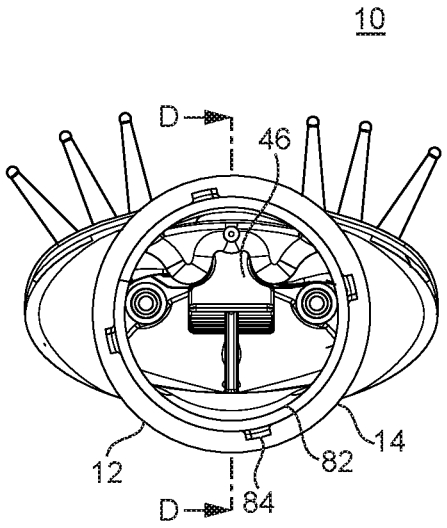
FIG. 4 is a front view of the attachment.

FIG. 1 is an external view of an attachment 10. The attachment 10 comprises an air inlet 12 for receiving an airflow from an air outlet end of a hot air styling device or similar apparatus. With reference also to FIGS. 2, 3 and 4, the air inlet 12 is defined by a casing which comprises an outer casing section 44, an inner casing section 45 and a fixing plate 62. The air inlet 12 is generally circular in shape, to enable an air-tight connection with a generally annular outlet end of the hot air styling device. An annular collar section 14 forms a smooth edge from an external surface of the hot air styling device to the outer casing section 44 of the attachment 10.

The attachment comprises at least one hair engaging member for engaging hair during the use of the hot air styling device. In this example, the attachment comprises two hair engaging members. Each hair engaging member comprises a moveable member and a set of bristles supported by the moveable member. In this example, a first moveable member 16 and a second moveable member 18 are both elongate in form and are disposed side by side. The moveable members are positioned longitudinally either side of a central fixed ledge 22. The central fixed ledge 22 forms part of an inner casing section 45 about which the outer casing section 44 extends. A first end of each moveable member is positioned towards the air inlet end of the attachment 10 and a second end of each moveable member is positioned towards a distal end of the attachment 10. The first moveable member 16 and the second moveable member 18 are positioned between both the outer casing section 44 and the inner casing section 45 and supported at the distal end of the attachment via fixing plate 62 for movement relative to the casing. At the distal end of the attachment is a cap 24, housing a movement mechanism for moving the moveable members relative to the casing, and attached cool tip 26.

Each moveable member has a curved outer surface. A plurality of parallel ribs 30 are positioned on the outer surface and the ribs 30 run perpendicular to the length of the moveable member. Two adjacent ribs 30 form a channel 32 therebetween. A total area of ribs 30 on each moveable member has a rectangular form which is surrounded by a smooth peripheral surface. Each rib 30 supports a respective row of bristles 20.

In this embodiment, the width of each channel 32 is preferably equal to or less than the height of the ribs 30. In an alternative embodiment, the width of each channel 32 is wider than the width of a rib 30. In further alternative embodiments, the channels 32 may comprise multi-faceted geometries as determined by fluid dynamics analyses.

Both the first moveable member 16 and the second moveable member 18 have an inner side face 34 adjacent to the central fixed ledge 22 and an outer side face 40 adjacent to a side wall 42 of the outer casing section 44. The inner side faces 34 of each moveable member comprise a series of regular indentations 36. The outer side faces 40 of each moveable member comprise a series of regular indentations 38. With reference to FIG. 1, these regular indentations are not a visible external feature of the attachment 10 when assembled. The regular indentations 36 along the inner side faces 34 preferably have a width of approximately 1 mm-2 mm and a spacing of approximately 10 mm-15 mm. The regular indentations 38 along the outer side faces 40 preferably have a width of approximately 2 mm-3 mm and a spacing of approximately 2 mm-3 mm.

A series of baffles 46 are connected to the underside of the central fixed ledge 22. As illustrated in FIG. 5, a side profile of each baffle 46 is generally curved, and the curvature of the baffles 46 in the series gradually decreases from the air inlet end of the attachment 10 to the distal end of the attachment 10. A rear side 50 of each baffle 46 is attached to a respective support 52, and this support 52 is also attached to a base 53 of the inner casing section 45. It is also envisaged that the baffles 46 may be supported in an alternative arrangement, such as the baffles solely being in contact with the central fixed ledge 22, or a pair of parallel supports at either side of each baffle 46 and positioned in alignment with the longitudinal axis of the attachment 10. In a preferred embodiment, the baffle 46 positioned closest to the air inlet 12 has a minimum radius of 6 mm.

With reference to FIG. 2, a curved base 54 of the outer casing section 44 extends between external side walls 42. A series of side vanes 56 is positioned internally on each side wall 42 of the outer casing section 44. Specifically, each side vane 56 is positioned in axial alignment with a protrusion 57 of an outer side face 40 of one of the moveable members, thus causing an air-tight blockage when the moveable member is moved relative to the outer casing section 44 so that consecutive side vanes 56 and protrusions 57 are in contact. When the moveable member is in this position, a channel between adjacent side vanes 56 is in axial alignment with a respective indentation 38 in the outer side face 40 of the moveable member, thus forming a series of channels.

In further reference to FIG. 2, components located at the distal end of the attachment 10 primarily function to enable a pivoting mechanism for the movement of the first moveable member 16 and the second moveable member 18 relative to the casing. Specifically, a pivot pin 58 is received into a centrally located hole 60 in an end face of the second end of each moveable member. These pivot pins 58 pass through a fixing plate 62 and are received into holes in the first side of the end cap 24. The central axis about which the first moveable member 16 tilts is shown in FIG. 2 denoted by dashed line X. The central axis about which the second moveable member 18 tilts is denoted by dashed line Y. Each moveable member has an angle of movement which is in the range from 5° to 30°. In a preferred embodiment, the angle of movement is 12°.

A linkage arm pin 64 protrudes from an outer side of the end face of the second end of each moveable member. Each linkage arm pin 64 passes through an oval hole 66 in the fixing plate 62 and is received in the respective end of a linkage arm 68. The linkage arm 68 functions to ensure that the first moveable member 16 and the second moveable member 18 move synchronously relative to the outer casing section 44.

A spring pin 70 protrudes from an inner side of the end face of the second end of each moveable member. Each spring pin 70 passes through an enlarged hole 72 in the fixing plate 62 and through a leg 74 of a torsion spring 76 and is finally received into respective holes in the first side of the end cap 24. The torsion spring 76 functions as an over-centre mechanism between a stable first position and a stable second position, ensuring that the first moveable member 16 and the second moveable member 18 can tilt between stable first position and a stable second position without hindrance.

The second side of the cap 24 includes a central extended feature, a cool tip 26, which is relatively insulated from the heat of the airflow within the attachment.

FIG. 3 is an external side view of the attachment 10 illustrating the location of the transverse cross-sections labeled B-B and C-C. FIG. 3 shows a first raised ridge 78 positioned adjacent to the first end of each moveable member and a second raised ridge 80 positioned adjacent to the second end of each moveable member. The first raised ridge 78 is part of the outer casing section 44. The second raised ridge 80 is part of the cap 24. The height of the first raised ridge 78 and the second raised ridge 80 is preferably in the range of approximately 1 mm to 4 mm.

FIG. 4 is a front view of the attachment 10 shown from the air inlet end 12. A connection ring 82 has four regularly spaced protrusions 84 which form a snap-fit feature by which the attachment 10 is fitted to the hot air styling device. A constructional line D-D cuts through each baffle 46 in the series.

Figure 5A:
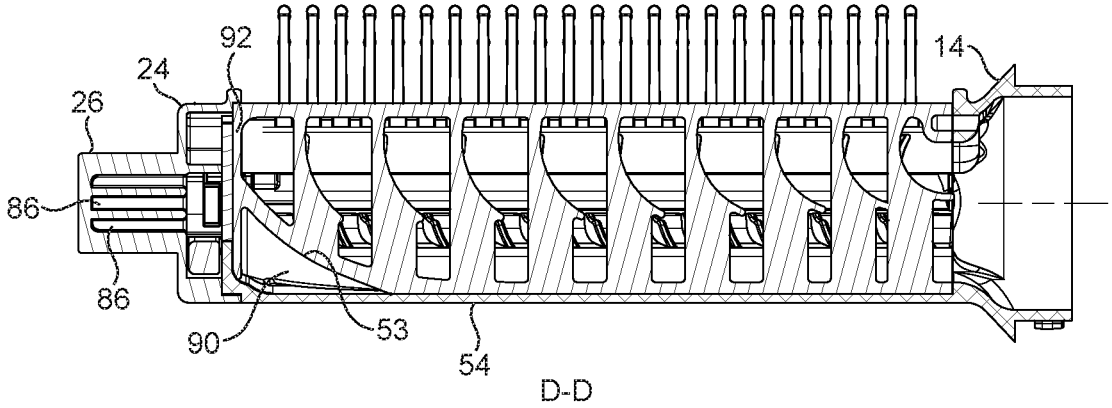
FIG. 5*a* is a cross-sectional view taken along line D-D in FIG. 4.

FIG. 5*a* is a cross-sectional view taken along line D-D in FIG. 4. Within the cool tip 26 there are several elongate cavities 86 which function to stiffen the cool tip 26, and also to minimize convection and minimize heat conduction to an outer surface of the cool tip 26. An internal cross-sectional area of the attachment 10 gradually reduces from the air inlet end towards the distal end of the attachment. Specifically, the base 53 of the inner casing section 45 slopes away from the base 54 of the outer casing section 44, towards the moveable members thereby creating a cavity 90 delimited by base 53 and base 54 and an end plate 92 of the inner casing section 45.

Figure 5B:
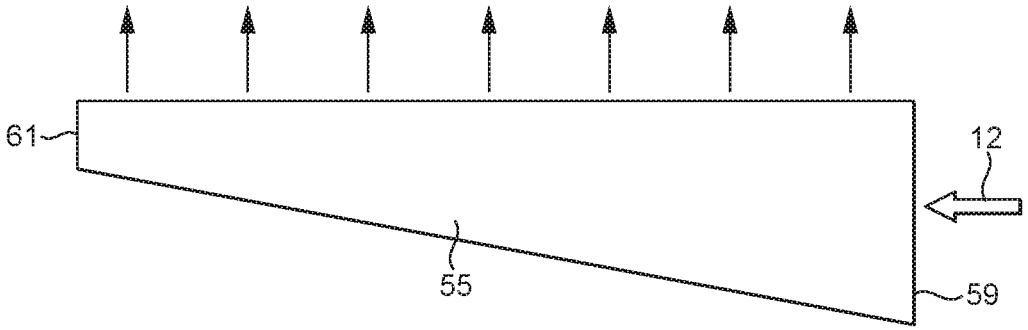
FIG. 5*b* is a schematic longitudinal cross-section of an internal volume of the attachment.

FIG. 5*b* schematically illustrates the airflow inlet 12 and multiple airflow outlets indicated by vertical arrows. A trapezoid 55 represents a cross-sectional view of the internal volume of the attachment, taken along line D-D in FIG. 4. A transverse cross-sectional area of the inside of the attachment at the upstream end is represented by a right-hand edge 59 of the trapezoid 55. A transverse cross-sectional area of the inside of the attachment at the distal end is represented by a left-hand edge 61 of the trapezoid 55. The cross-sectional area of the internal volume of the attachment tapers gradually between the minimum cross-sectional area 61 at the distal end and the maximum cross-sectional area 59 at the upstream end.

In one embodiment, the base 53 has a smooth curved profile with greatest height at the centre of the end plate 92 with the profile sloping down towards the side walls 42 and away from the end plate 92. In further embodiments, the gradual tapering of the internal cross-sectional area of the attachment 10 can be realized in alternative configurations of the base 53.

Figure 6A:
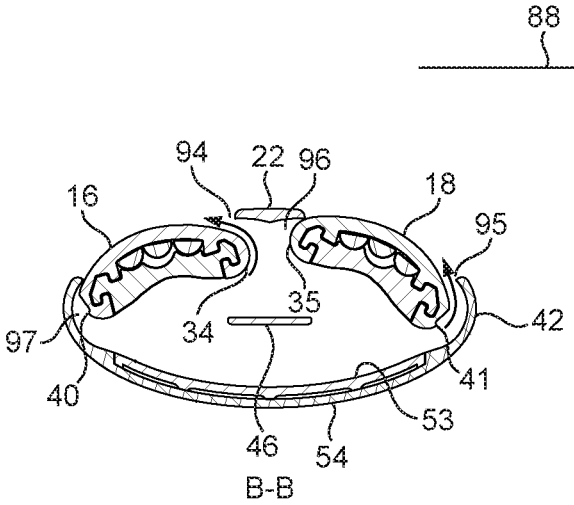
FIG. 6*a* is a cross-sectional view taken along line B-B in FIG. 3 showing moveable members in a first configuration.
Figure 6B:
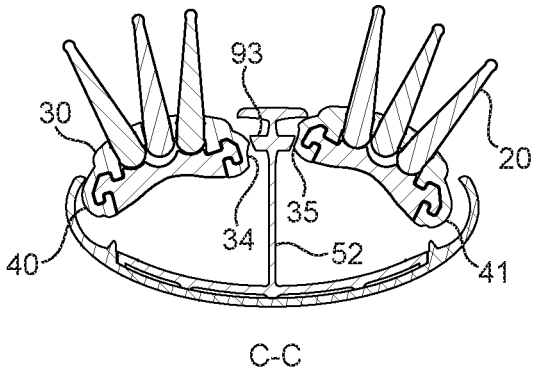
FIG. 6*b* is a cross-sectional view taken along line C-C in FIG. 3 showing the moveable members in the first configuration.
Figure 6C:
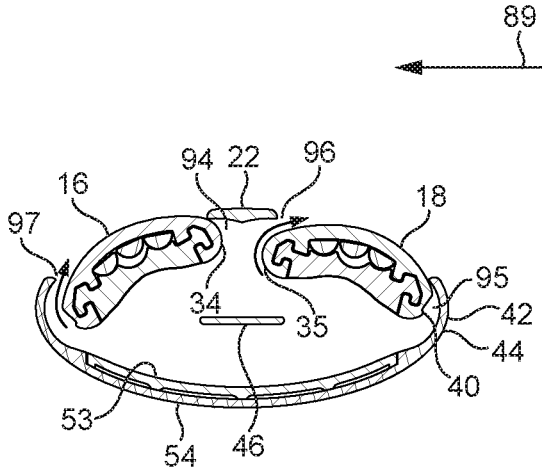
FIG. 6*c* is a cross-sectional view taken along line B-B in FIG. 3 showing moveable members in a second configuration.
Figure 6D:
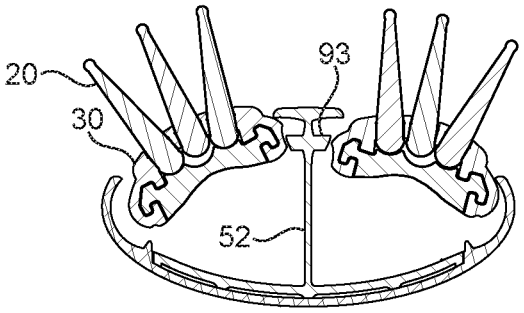
FIG. 6*d* is a cross-sectional view taken along line C-C in FIG. 3 showing the moveable members in the second configuration.

A "see-saw movement" of the moveable members will now be described with reference to FIGS. 6*a* to 6*d*. FIGS. 6*a* and 6*b* show cross-sectional views taken along lines B-B and C-C in FIG. 3 when the moveable members are in a first configuration relative to the casing. FIGS. 6*c* and 6*d* are similar cross-sectional views to FIGS. 6*a* and 6*b*, but when the moveable members are in a second configuration relative to the casing. In use, the action of the user drawing the attachment through the hair creates a tension in the bristles 20 in the opposing direction. The tension in the bristles is consequently present in each moveable member, and each moveable member moves in compliance with the direction of the tension force, so that the moveable members adopt either the first configuration or the second configuration during use of the attachment 10.

FIG. 6*a* and FIG. 6*b* show the position of each moveable member in the first configuration when the attachment 10 is moved, in use, in a left to right direction as indicated by an arrow 88, through the hair of a user. The first moveable member 16 illustrated at the left side of FIG. 6*a* is in a first position relative to the casing, in which an outer section of the upper surface is in flush, air-tight contact with the side wall 42 of the outer casing section 44. The inner side face 34 of first moveable member 16 is positioned below, and vertically overlapping with, the central fixed ledge 22. A first, inner air outlet 94 is formed between the central fixed ledge 22 and the inner side face 34 of the first moveable member 16.

The second moveable member 18 illustrated at the right side of FIG. 6*a* is in a first position relative to the casing, in which an inner side face 35 is in flush, air-tight contact with the central fixed ledge 22. The second moveable member 18 has an outer section of the upper surface positioned below the side wall 42 of the outer casing section 44. A second, outer air outlet 95 is formed between the second moveable member 18 and the side wall 42 of the outer casing section 44.

It will be apparent to the skilled person that FIG. 6*b* illustrates the moveable members in the same position as in FIG. 6*a*. Cross-section C-C (in FIG. 3) cuts through a support 52 of a baffle 46 and through a narrow neck 93 of a baffle 46. The inner side face 34 of the first moveable member 16 is in contact with the narrow neck 93 of a baffle 46. The regularly spaced baffles 46 and the regularly spaced indentations 36 on the longitudinal inner side faces 34 of each moveable member are in contact, thereby dividing the inner air outlet 94 into a series of central air outlet apertures. Similarly, the regularly spaced internal side vanes 56 and the regularly spaced protrusions 57 on the outer side faces 40 of each moveable member are in contact thereby dividing the outer air outlet 95 into a series of outer air outlet apertures.

When the direction of the brushing action by the user is reversed and equally the direction of the tension force in the bristles 20 is reversed, then the moveable members move synchronously into their opposite position. Thus, the first moveable member 16 and the second moveable member 18 are in the second configuration relative to the casing as illustrated in FIG. 6*c* and FIG. 6*d*. Specifically, the attachment 10 is moved, in use, in a right to left direction as indicated by arrow 89. The first moveable member 16 illustrated at the left side of FIG. 6*c* is in the second position, in which the inner side face 34 is in contact with the central fixed ledge 22 and the outer side face 40 is positioned below, the outer side wall 42 of the outer casing section 44. A third, outer air outlet 97 is formed between the first moveable member 16 and the side wall 42 of outer casing section 44.

The second moveable member 18 illustrated at the right side of FIG. 6*c* is in the second position, in which an outer side face 40 is in contact with the outer side wall 42 of the outer casing section 44. The second moveable member 18 has an inner section of the upper surface positioned below, and vertically overlapping with, the central fixed ledge 22. A fourth, inner air outlet 96 is formed between the second moveable member 18 and the central fixed ledge 22.

It will be apparent to the skilled person that FIG. 6*d* illustrates the moveable members in the second configuration, thus the same position as in FIG. 6*c*. Cross-section C-C (in FIG. 3) cuts through a support 52 of a baffle 46 and through a narrow neck 93 of a baffle 46.

Such a synchronous motion between two opposing positions is a so-called "see-saw" action. The "see-saw" motion is both enabled and limited by the oval holes 72 and 66 in the fixing plate 62 through which the pivot pins 58 and linkage arm pins 64 are positioned, respectively. The attachment 10 has a single open inner air outlet and a single open outer air outlet when the moveable members adopt one of the two different stable configurations. For example, when the moveable members are in the first configuration, airflow outlets 94, 95 are open, and airflow outlets 96, 97 are closed. When the moveable members are in the second configuration, airflow outlets 94, 95 are closed and airflow outlets 96, 97 are open.

In use, the attachment 10 is connected to the airflow outlet end of a hot air styling device. The airflow passes from the hot air styling device through the air inlet 12 and into the attachment 10. A front side 48 of each of the series of baffles 46 functions to change the direction of the incident airflow. Specifically, the incident airflow from the air inlet 12 is primarily parallel to a longitudinal axis of the attachment 10. The baffles 46 alter this path through approximately 90 degrees in the direction of the central fixed ledge 22 and towards the open inner air outlet 94. Both the front side 48 and a rear side 50 of each baffle 46 assists in altering the airflow direction. In cooperation with the regular indentations 36 on the inner side face 34 of each moveable member, the series of baffles 46 form a first series of air jets exiting the attachment 10.

Additionally, the side vanes 56 function to direct airflow towards the open outer air outlet 95 and, in cooperation with the regular indentations 38 in the outer side face 40 of each moveable member, form a second series of air jets exiting the attachment 10.

Air flow exiting the attachment 10 through one of the open inner air outlet and open outer air outlet is directed to flow over the outer surface of an adjacent one of the moveable members by virtue of the profile of the moveable members. The form of the side vanes 56 and the baffles 46 enables the exiting airflow jets to be straight and parallel and flow evenly over the surface of the moveable members thereby attracting the hair to the surface of the moveable members. In an exemplary embodiment, the airflow velocity exiting each airflow outlet is around 30 m/s.

Ambient airflow is drawn into this surface air flow as a consequence of the dimensions of the airflow outlet and the profile of each moveable member. Therefore, the airflow through the channels 32 and along the length of the user's hair is augmented by ambient airflow. Furthermore, the form and dimensions of the channels 32 enhance flow attachment as the airflow moves over the surface of the moveable member.

With reference to FIG. 6*a* and FIG. 6*b*, when the attachment 10 is moved, in use, in a left to right direction as indicated by the arrow 88 at the top of the figure, then airflow over the surface of each moveable member is in the opposing direction, as indicated by the smaller airflow arrows. With reference to FIG. 6*c* and FIG. 6*d*, when the direction of use of the attachment 10 is reversed, then the direction of airflow across the surface of each moveable member is also reversed.

The cross-sectional area of the internal volume of the attachment 10 reduces gradually towards the downstream end of the attachment 10. The function of this reduction in cross-sectional area is to ensure a constant pressure of airflow exiting the attachment along the entire length of the air outlets and to prevent turbulent flow. The reduction in cross-sectional area is proportional to a falling mass flow rate of the airflow within the attachment. The mass flow rate falls as airflow exits the attachment 10, via the inner air outlet and outer air outlet, from the upstream end of the attachment to the downstream end of the attachment. Consequently, the reduction of the cross-sectional area results in a constant airflow velocity exiting the attachment along the entire length of the air outlets. It is also observed that attachment of airflow to vanes and baffles is improved as a consequence of the progressive reduction of the internal cross-sectional area.

The first raised ridge 78 and the second raised ridge 80 function to avoid undesirable entrainment of ambient air into the even, parallel airflow moving through the channels 32.

Figure 7A:
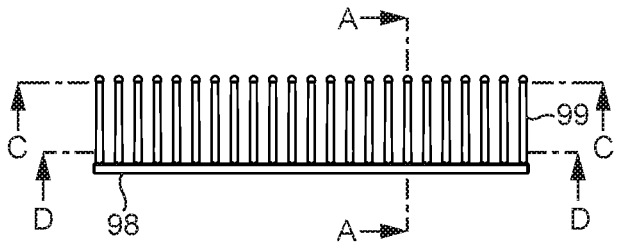
FIG. 7*a* is a side view of a row of bristles for the attachment.
Figure 7B:
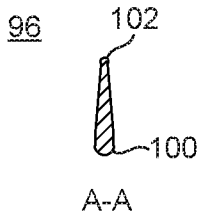
FIG. 7*b* is a cross-sectional view taken along line A-A in FIG. 7*a;*
Figure 7C:
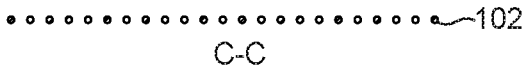
FIG. 7*c* is a cross-sectional view taken along line C-C in FIG. 7*a;*
Figure 7D:
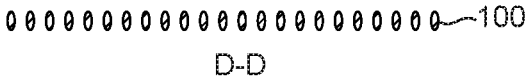
FIG. 7*d* is a cross-sectional view taken along line D-D in FIG. 7*a;*

FIGS. 7*a* to 7*d* illustrate a preferred form of the bristles for the attachment. FIG. 7*a* shows a row of bristles, in which each bristle 99 is attached to an elongate base plate 98. Vertical cross-section A-A through a bristle 99 is shown in FIG. 7*b*. The base end 100 of the bristle 99 is broader than the tip 102 of the bristle and the sides are substantially straight, with an approximately spherical form at the tip 102 of the bristle 99. As shown in FIG. 7*c*, a cross-section through the tip 102 of each bristle is a circle. FIG. 7*d* shows a cross-section through the base end 100 of each bristle 99 is an oval. Once assembled, the longer dimension of the oval profile of each bristle 20 is aligned with the longer dimension of each rib 30 on each moveable member. In an alternative embodiment, each bristle 99 has an oval cross-section for the entirety of the bristle and the cross-section may be gradually reducing in size towards the tip 102 of the bristle 99.

Furthermore, the form of each bristle 99 may be contoured to optimize flow attachment as the airflow moves between the bristles 20 and over the surface of each moveable member. In a preferred embodiment, the bristles 20 are able to flex and may be approximately 15 mm in length. The bristles 20 may be formed with or without the approximately spherical end form.

It will be apparent to the skilled person that the bristles of the present hot air styling device attachment may be assembled singly or in pre-formed rows of two or more connected bristles (as shown in FIG. 7*a*). Each bristle 99 is positioned into the rib 30 and, optionally, the rib 30 may allow movement of each bristle 99 in one or more directions. For example, small cushioned movements of each bristle 99 along the longitudinal axis of the bristle may improve the comfort of the user experience because the bristles would have a reduced force against the scalp.

With reference to FIG. 1, the upper surface of each moveable member has an arc form and therefore, the ribs 30 describe the same arc form. Consequently, the vertical alignment of bristles 20 held within a single rib 30 is not parallel.

Figure 8:
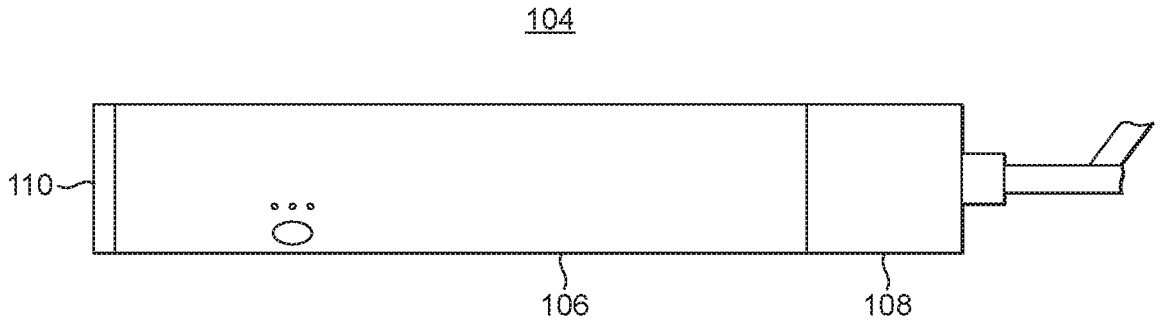
FIG. 8 is a side view of an example of a hot air styling device to which an attachment may be connected.

FIG. 8 shows an example of a hot air styling device 104 to which the attachment 10 may be connected. The hot air styling device comprises a generally tubular handle 106 having an air inlet 108 and an air outlet 110 at opposing ends. At the air inlet end of the handle, an array of apertures extending around and partially along the handle 106, provides an air inlet 108. A fan unit within the handle 106 comprises a fan and a motor. In use, the motor drives the fan and air is drawn in through the air inlet, along an air flow path which extends through the length of the handle 106. The air is optionally heated by a heater before exiting the hot air styling device at the air outlet 110.

In a further embodiment, the bases 53, 54 may be provided with a channel between them which functions as an insulated coolwall cavity. In a further preferred embodiment, the cavity 90 for reducing the inner cross-sectional area of the attachment may be continuous with the coolwall cavity between the bases 53, 54. Such a coolwall cavity functions to reduce the temperature of the base 54 of the outer casing section 44 which may come into contact with the user.

In a further structural alternative, a coolwall may comprise a separate layer of material covering the base and walls of the outer casing section 44 of the attachment 10, maintained at a predetermined distance from the base and walls of the outer casing section 44 by a minimum number of joining ribs. The coolwall does not create a closed cavity, but forms a channel between the coolwall and the outer casing section 44 which may encourage airflow through the coolwall channel by the Venturi effect when in use.

It will be apparent to the skilled person that the biasing function of the torsion spring 76 may be realized in several alternative ways. For example, a magnetic latch or weighted moveable members or integrated ball bearings in a detent mechanism may be used.

The attachment may be fabricated from any suitable heat resistant materials, and in a preferred embodiment the casing and moveable members are fabricated from glass-filled nylon. The highest preferred operating temperature of such an attachment connected to a hot air styling device is approximately 130° C.

In the present example of an attachment, two parallel moveable members are described. Alternatively, a single moveable member or three or more moveable members may be used within the outer casing section 44. An embodiment comprising a single moveable member would necessarily omit the central baffles and central fixed ledge. An alternative embodiment comprising multiple moveable members may include multiple rows of central baffles positioned to create airflow jets between the moveable members. Furthermore, in an alternative embodiment of the attachment, the moveable members may be adapted to move in a hinged movement or a sliding movement.

In the present example of an attachment 10, as illustrated in the accompanying figures, three rows of bristles 20 are shown on each moveable member. However, it is clear to the skilled person that the number of rows of bristles on each moveable member may be greater or smaller than three. In particular, advantage is found in an attachment without bristles, so that the user may benefit from the hair smoothing effects of the airflow path without the harsher effect of the bristles through the hair. Alternatively, bristles 20 may be positioned on the outer casing section 44, instead of, or in addition to, bristles 20 on each moveable member. Further, embodiments which have more than one moveable member may not have bristles positioned on each moveable member.

The invention is not limited to the detailed description given above. Variations will be apparent to the person skilled in the art.

The invention claimed is:

1. An attachment for a hair styling apparatus comprising:

a casing having a length in a longitudinal direction of the attachment and comprising a base that extends the length of the casing, and an air inlet for receiving an airflow from a hair styling apparatus; and two hair engaging members positioned parallel to one another on an opposite side of the attachment from the base of the casing and the hair engaging members having lengths that extend along the longitudinal direction, each of the hair engaging members supported by the casing and configured to move relative to the casing; and an over centre mechanism connecting the two hair engaging members, wherein the two hair engaging members move between a first stable position and a second stable position relative to the casing under the action of the over centre mechanism, the over centre mechanism biasing the two hair engaging members toward the nearer of the first stable position and the second stable position;

wherein a first airflow outlet is formed between a first hair engaging member of the two hair engaging members and the casing when the two hair engaging members are in the first stable position, and wherein a second airflow outlet is formed between a second hair engaging member of the two hair engaging members and the casing when the two hair engaging members are in the second stable position.

2. The attachment of claim 1, wherein each of the hair engaging members is configured to move in a rocking movement, relative to the casing.

3. The attachment of claim 1, wherein each of the hair engaging members is pivotably supported within the casing and through a central axis of the hair engaging member.

4. The attachment of claim 3, wherein each of the hair engaging members is pivotably supported by pivot pins that mount the hair engaging member within the casing.

5. The attachment of claim 1, wherein each of the hair engaging members has an angle of movement which is in a range of from 10° to 30°.

6. The attachment of claim 1, wherein each of the hair engaging members is configured to move into the first stable position when the attachment is drawn through hair of a user in a first direction and each of the hair engaging members is configured to move into the second stable position when the attachment is drawn through the hair of the user in a second direction opposing the first direction.

7. The attachment of claim 1, wherein each of the hair engaging members has an elongate form.

8. The attachment of claim 1, wherein the first hair engaging member and the second hair engaging member move synchronously.

9. The attachment of claim 1, wherein the over centre mechanism is a torsion spring connected between the two hair engaging members.

10. The attachment of claim 1, wherein the attachment comprises bristles and all of the bristles of the attachment are mounted to the two hair engaging members.

11. The attachment of claim 1, wherein the casing has a non-circular cross sectional shape to accommodate the two hair engaging members on the side of the attachment opposite the base.

12. The attachment of claim 1, wherein the casing further comprises an outer casing section, and an inner casing section coupled to and fixed relative to the outer casing section, the inner casing section comprising a ledge, the two hair engaging members are positioned such that the ledge of the inner casing section is located between the hair engaging members;

a respective first side airflow outlet is formed between the casing and each of the hair engaging members when each of the hair engaging members is in the respective first position, wherein a length of the respective first side airflow outlet extends in the longitudinal direction, the first side airflow outlet of the first hair engaging member comprising the first airflow outlet;

a respective second side airflow outlet, spaced from the respective first side airflow outlet, is formed between the casing and each of the hair engaging members when each of the hair engaging members is in the respective second position, wherein a length of the respective second side airflow outlet extends in the longitudinal direction, the second side airflow outlet of the second hair engaging member comprising the second airflow outlet;

wherein each of the first side airflow outlets is open and each of the second side airflow outlets is closed when each of the hair engaging members is in the respective first position; and wherein each of the first side airflow outlets is closed and each of the second side airflow outlets is open when the hair engaging member is in the respective second position, and wherein airflow at the air inlet into the attachment is parallel to the length of each of the first side airflow outlets and each of the second side airflow outlets.

13. The attachment of claim 12, wherein each first side airflow outlet and second side airflow outlet is configured so that airflow exits the first side airflow outlet and second side airflow outlets in a direction that is opposite of a direction that the hair engaging members are moved through hair of a user.

14. The attachment of claim 12, wherein each of the first side airflow outlet and second side airflow outlet is located on the same side of a plane that extends in the longitudinal direction and bisects the attachment.

15. The attachment of claim 12, wherein each of the first side airflow outlet and the second side airflow outlet of each of the hair engaging members comprise a plurality of outlet apertures.

16. The attachment of claim 15, wherein each of the first side airflow outlet and the second side airflow outlet of each of the hair engaging members comprise a plurality of outlet apertures positioned in a row.

17. The attachment of claim 12, wherein each of the first side airflow outlet and the second side airflow outlet of each of the hair engaging members are defined by a respective side face of the hair engaging member and a respective part of the casing.

18. The attachment of claim 12, wherein each of the first side airflow outlet and the second side airflow outlet of each of the hair engaging members is a slot shape.

19. The attachment of claim 12, wherein each of the first side airflow outlet and the second side airflow outlet of each of the hair engaging members extends substantially the length of the hair engaging member.

20. The attachment of claim 12, wherein, in a first configuration of the attachment:

a first hair engaging member of the two hair engaging members is in the respective first position and defines the respective first side airflow outlet with the ledge, and a second hair engaging member of the two hair engaging members is in the respective first position and defines the respective first side airflow outlet with the outer casing section.

21. The attachment of claim 20, wherein, in a second configuration of the attachment:

the first hair engaging member is in the respective second position and defines the respective second side airflow outlet with the outer casing section, and the second hair engaging member is in the respective second position and defines the respective second side airflow outlet with the ledge.

* * * * *